US007653678B2

(12) United States Patent
Bushman et al.

(10) Patent No.: US 7,653,678 B2
(45) Date of Patent: Jan. 26, 2010

(54) DIRECT DIGITAL SYNTHESIS CIRCUIT

(75) Inventors: Michael L. Bushman, Hanover Park, IL (US); Neal W. Hollenbeck, Palatine, IL (US); Patrick L. Rakers, Kildeer, IL (US)

(73) Assignee: Freescale Semiconductor, Inc., Austin, TX (US)

( * ) Notice: Subject to any disclaimer, the term of this patent is extended or adjusted under 35 U.S.C. 154(b) by 728 days.

(21) Appl. No.: 11/457,380

(22) Filed: Jul. 13, 2006

(65) Prior Publication Data

US 2008/0016141 A1 Jan. 17, 2008

(51) Int. Cl.
*G06G 7/16* (2006.01)

(52) U.S. Cl. ..... 708/845

(58) Field of Classification Search ..... 708/845, 708/271; 327/105–107
See application file for complete search history.

(56) References Cited

U.S. PATENT DOCUMENTS 5,642,071 A * 6/1997 Sevenhans et al. ..... 327/359
5,708,383 A * 1/1998 Lee ..... 327/356
5,995,819 A * 11/1999 Yamaji et al. ..... 455/326
6,992,609 B1 1/2006 Zelenin et al.

* cited by examiner

*Primary Examiner*—Tan V Mai
(74) *Attorney, Agent, or Firm*—Vedder Price P.C.

(57) ABSTRACT

A direct digital synthesis circuit (108) includes a plurality of current sources (210, 211, 212), an output circuit (200), and a logical multiplier circuit (202). The output circuit (200) provides a synthesized waveform (164) output and includes a first (206) and second branch (208). The logical multiplier circuit (202) is operatively coupled to the plurality of current sources (210, 211, 212) and to the output circuit (200). The logical multiplier circuit (202) is operative to receive a plurality of signals. The logical multiplier circuit is also operative to selectively increase a first current flow through the first branch (206) by a determined magnitude and decrease a second current flow through the second branch (208) by the determined magnitude based on the plurality of signals. The synthesized waveform (164) is based on the first and second currents.

20 Claims, 7 Drawing Sheets

-PRIOR ART-

-PRIOR ART-

DIRECT DIGITAL SYNTHESIS CIRCUIT

FIELD OF THE INVENTION

The present disclosure relates generally to circuits, methods and apparatus that generate waveforms, and more particularly to circuits, methods and apparatus that generate a synthesized waveform.

BACKGROUND OF THE INVENTION

A radio frequency (RF) modulator receives a baseband signal and generates a modulated signal based thereon. For example, an RF modulator may be used to receive a baseband signal from an audio and/or video circuit. The audio and/or video circuit may be responsive to a device such as a digital video disk (DVD) player, a camcorder, a video gaming system, a videocassette recorder (VCR), a digital media player, or any other suitable device. The RF modulator may receive the baseband signal and generate a modulated signal within a particular frequency band or channel. An output device, such as an analog television, a radio, or any other suitable device, may be tuned to the particular channel in order to receive the modulated signal and generate an audio and/or video output based thereon.

The modulated signal may be divided into multiple subcarriers (e.g., a video and audio subcarrier) that operate at different frequencies within the frequency band or channel. This method, commonly referred to as Frequency Division Multiplexing (FDM), allows each subcarrier to be modulated independently and thus each subcarrier may include independent information. Common modulation techniques for each subcarrier include, but are not limited to, amplitude modulation (AM), frequency modulation (FM), quadrature amplitude modulation (QAM), quadrature phase shift keying (QPSK), and other suitable modulation techniques known in the art. Each modulated subcarrier can be combined and simultaneously transmitted within the frequency band or channel.

The subcarriers typically include harmonics that are multiples of a frequency at which they are oscillating. For example, if the subcarrier is oscillating at a fundamental frequency f, harmonics would be included at $1f, 2f, 3f, \ldots, Nf$. These harmonics may cause interference on adjacent subcarriers and/or frequency bands or channels, which is undesirable. It is therefore desirable to suppress harmonics that are included in the subcarriers.

One method to suppress the harmonics is to use a filter that is designed to allow the fundamental frequency to pass while blocking the others. In order to suppress low order harmonics (e.g., $2f, 3f, \ldots$) of a subcarrier, a high order filter is required. However, high order filters often have variations in filtering characteristics due to manufacturing variations, which makes it difficult to suppress low order harmonics without adversely affecting the subcarrier.

Another method to suppress the harmonics is to generate a synthesized waveform based on the subcarrier that includes the audio and/or video information. FIG. 1 discloses a direct digital synthesis (DDS) circuit 10 that is operative to generate a synthesized digital waveform based on the subcarrier frequency. The circuit 10 is operative to receive a plurality of control signals 1, 2, 3, and 4 that are generated by a subcarrier oscillator (not shown). The circuit 10 is operative to generate a synthesized digital waveform of either a frequency or amplitude modulated subcarrier. For example, if a synthesized waveform of a frequency modulated subcarrier is desired, a voltage positive with respect to Vs− may be applied to terminal 12 and the subcarrier oscillator is frequency modulated. However, if a synthesized waveform of an amplitude modulated signal is desired, a voltage positive with respect to Vs− may be applied to terminal 14 and the amplitude modulated signal may be operatively coupled to the AM input.

Terminal 16 is operatively coupled to transistor 17 and is operative to receive control signal 1. Terminal 18 is operatively coupled to transistor 19 and is operative to receive control signal 2. Control signals 1 and 2 oscillate at a first frequency and are typically square waves that are 180 degrees out of phase. Terminal 20 is operatively coupled to multiple transistors generally identified at 22 and is operative to receive control signal 3. Terminal 24 is operatively coupled to multiple transistors generally identified at 26 and is operative to receive control signal 4. Control signals 3 and 4 oscillate at a second frequency and are typically square waves that are 180 degrees out of phase. During operation, the control signals 1-4 enable and disable current flow through respective transistors 17, 19, 22, 26. In addition, signals 3 and 4 enable and disable current flow I1 and I2 through transistors 27 and 29, respectively. When the transistors 17, 19, 22, 26, 27, and 29 are enabled and disabled according to control signals 1-4, currents I3 and I4 are varied generating a synthesized waveform Vout between output terminals 28 and 30. Although this circuit 10 works, it exhibits poor common mode rejection and as such variations in the power supply can appear in the output signal.

To more clearly describe the operation of the circuit 10, FIG. 2 is provided. FIG. 2 depicts exemplary waveforms of currents I3 and I4 and the synthesized waveform Vout at 50. FIG. 2 also depicts operation of the circuit 10 during time t1 to t2 at 52 and time t2 to t3 at 54. At time t1, transistor 27 is enabled allowing I1 to flow and transistor 29 is disabled. From time t1 to t2, 14 is the only current available to generate the synthesized waveform Vout. At time t2, transistor 29 is enabled allowing 12 to flow and transistor 27 is disabled. From time t2 to t3, I3 is the only current available to generate the synthesized waveform Vout. Since currents I1 and I2 are not continually flowing during operation, the circuit 10 exhibits a poor common mode rejection.

It is therefore desirable, among other things, to provide a circuit capable of generating a synthesized waveform that suppresses subcarrier harmonics and that exhibits improved common mode rejection.

BRIEF DESCRIPTION OF THE DRAWINGS

The invention will be more readily understood in view of the following description when accompanied by the below figures and wherein like reference numerals represent like elements.

DETAILED DESCRIPTION

Figure 1:
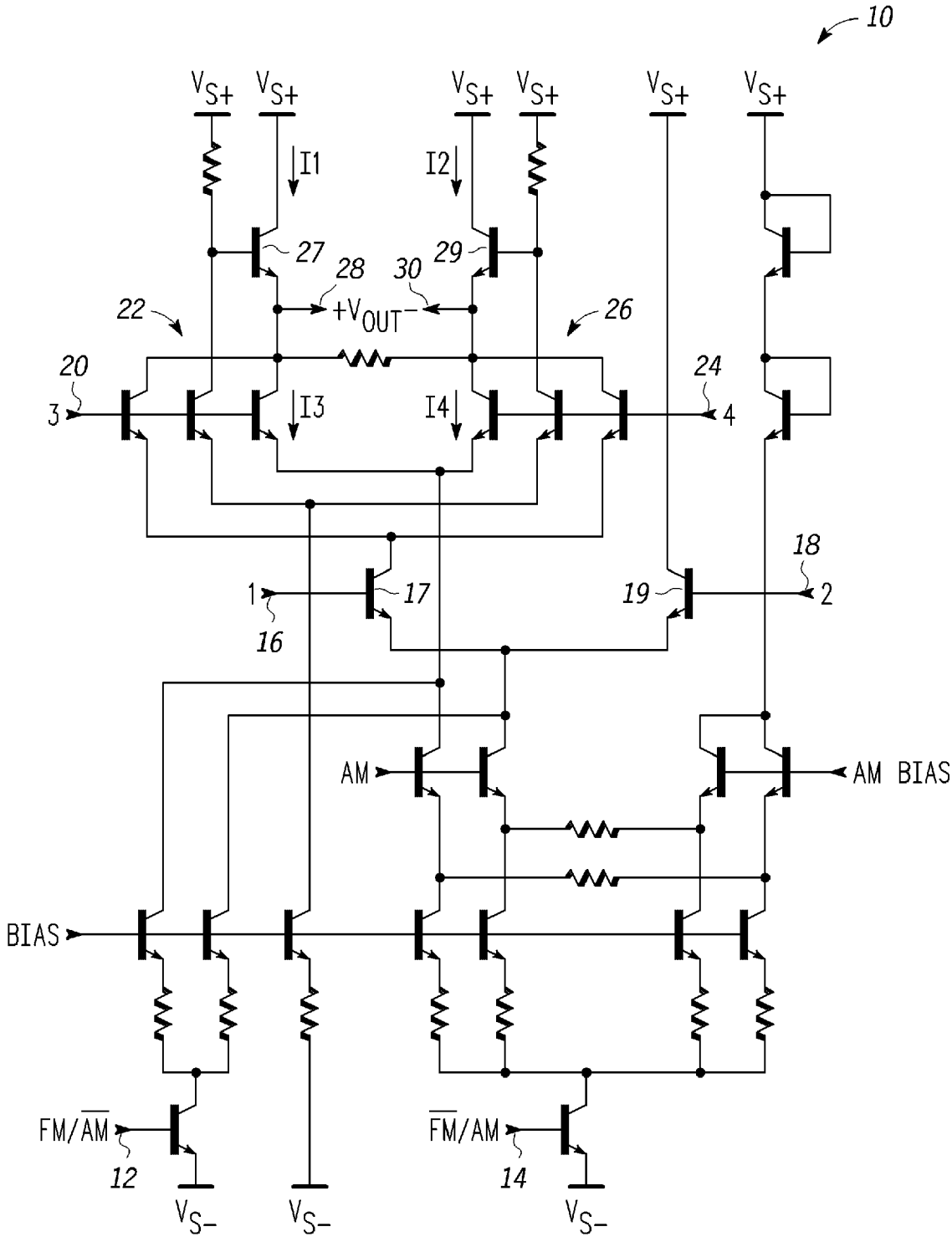
FIG. 1 is an exemplary circuit that is capable of generating a synthesized waveform according to the prior art.
Figure 2:
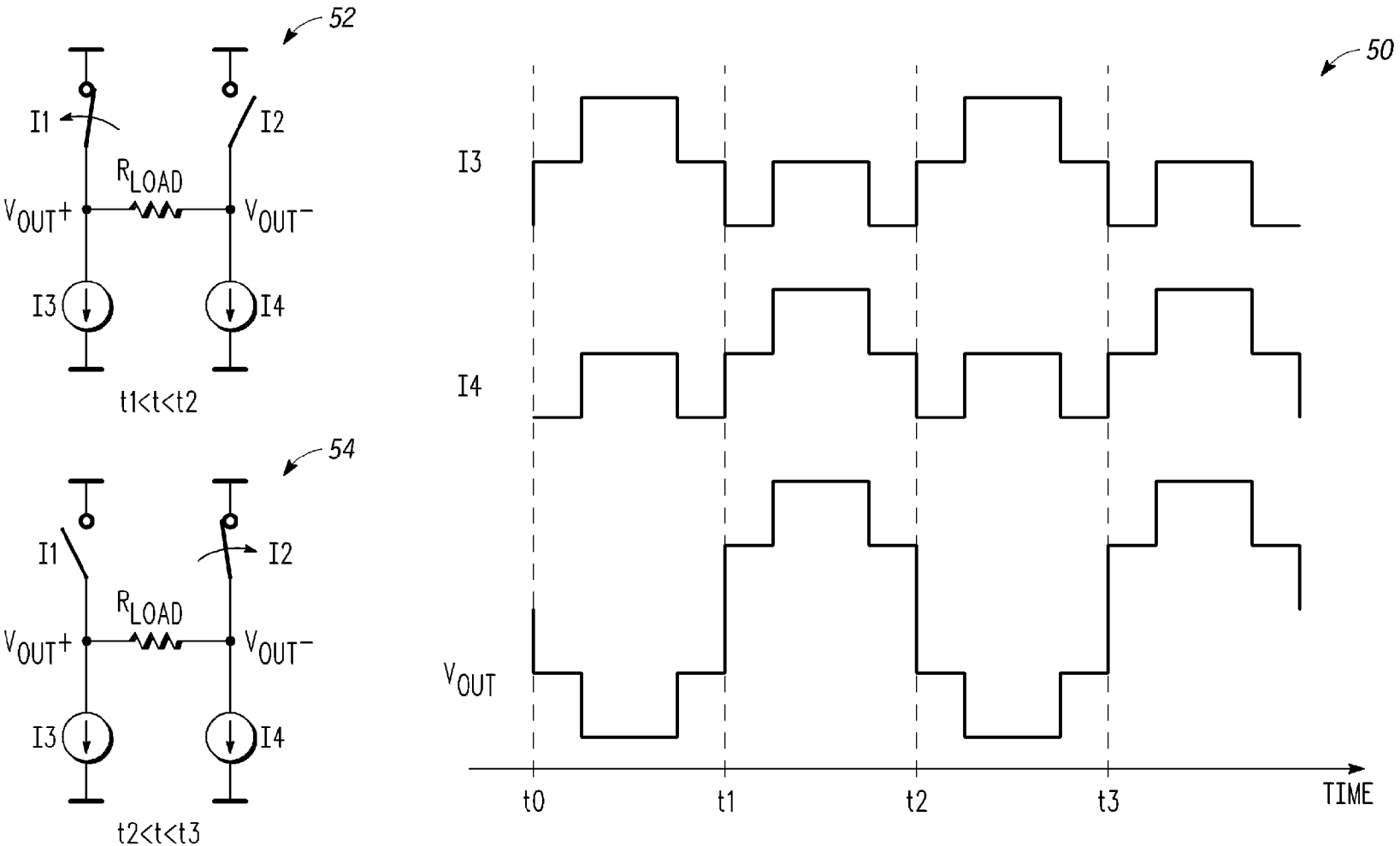
FIG. 2 is an exemplary depiction of characteristics of the exemplary circuit of FIG. 1.

In one example, a direct digital synthesis circuit includes a plurality of current sources, an output circuit, and a logical multiplier circuit. The output circuit provides a synthesized waveform output and includes a first and second branch. The logical multiplier circuit is operatively coupled to the plurality of current sources and to the output circuit. The logical multiplier circuit is operative to receive a plurality of signals. The logical multiplier circuit is also operative to selectively increase a first current flow through the first branch by a determined magnitude and decrease a second current flow through the second branch by the determined magnitude based on the plurality of signals. The synthesized waveform is based on the first and second currents.

In one example, the first branch includes a first resistive element operatively coupled to the logical multiplier circuit. The second branch includes a second resistive element operatively coupled to the logical multiplier circuit.

In one example, the output circuit includes a resistive element operatively coupled between the first and second branches. The first branch includes a first current source operatively coupled to the logical multiplier circuit and to the resistive element. The second branch includes a second current source operatively coupled to the logical multiplier circuit and to the resistive element.

In one example, the logical multiplier circuit includes a plurality of logical multiplication cells, such as an initial cell and a next cell, that each include a plurality of metal oxide semiconductor field effect transistor (MOSFET) logical multiplication stages. The synthesized waveform has up to the 4N-2 harmonic suppressed. It will also be recognized that some higher harmonics may also be suppressed.

In one example, the plurality of current sources are operative to receive a modulating signal. The determined magnitude is based on the modulating signal.

In one example, the plurality of MOSFET logical multiplication stages comprise a first, second, and third MOSFET. The first MOSFET includes a first terminal operatively coupled to the output circuit. The second MOSFET includes a second terminal operatively coupled to the output circuit. The third MOSFET includes a third terminal operatively coupled to at least one of the plurality of current sources and a fourth terminal operatively coupled to a fifth terminal of the first MOSFET and to a sixth terminal of the second MOSFET.

In one example, an integrated circuit includes a subcarrier oscillator circuit, a control signal generator, and the direct digital synthesis circuit. The subcarrier oscillator circuit is operative to generate a subcarrier frequency. The control signal generator is operative to receive the subcarrier frequency and generate the plurality of signals based thereon.

In one example, the integrated circuit includes a radio frequency mixer that is operative to generate a radio frequency signal based on the synthesized waveform.

In one example, the subcarrier oscillator is operative to receive a frequency modulating signal and generate the subcarrier frequency based thereon.

In one example, a modulation system includes an input circuit, and a modulation circuit. The input circuit is operative to generate a baseband signal. The modulation circuit includes a baseband circuit, the subcarrier oscillator, the control signal generator, and the direct digital synthesis circuit. The baseband circuit is operative to receive the baseband signal and generate the modulating signal based thereon.

As used herein, the term circuit and/or device can include an electronic circuit, one or more processors (e.g., shared, dedicated, or group of processors such as but not limited to microprocessors, DSPs, or central processing units) and memory that execute one or more software or firmware programs, a combinational logic circuit, an ASIC, and/or other suitable components that provide the described functionality.

Figure 3:
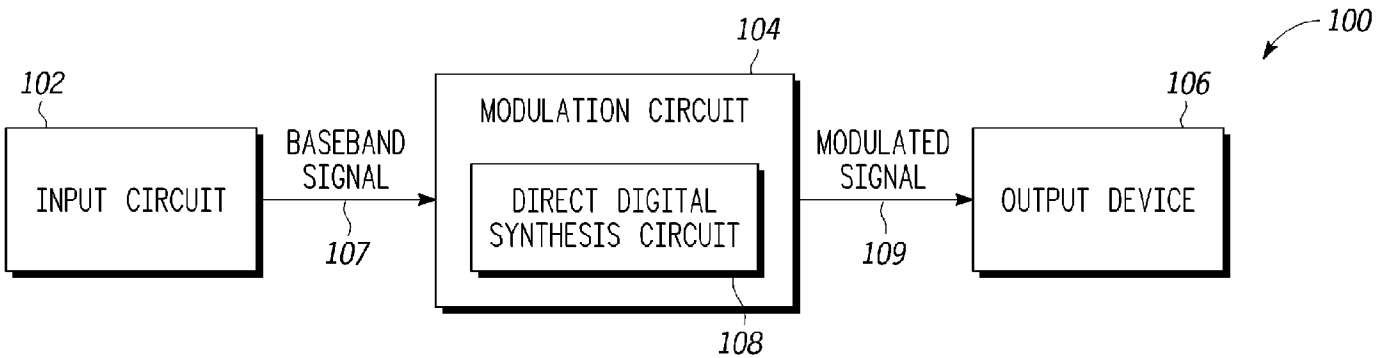
FIG. 3 is a functional block diagram of an exemplary modulation system with a modulation circuit that includes a direct digital synthesis circuit to suppress harmonics in a subcarrier signal.

Referring now to FIG. 3, a functional block diagram of an exemplary modulation system 100 is depicted. The modulation system 100 may include an input circuit 102, a modulation circuit 104, and an output device 106. The input circuit 102 may be operative to generate a baseband signal 107. Exemplary input circuits 102 include, but are not limited to, a digital video decoder circuit, a digital video disk (DVD) player, a camcorder, a video gaming system, a videocassette recorder (VCR), a digital media player, or any suitable structure that generates a baseband audio and/or video signal. For example, if the input circuit 102 is in a DVD player, the DVD player may be operative to read audio and/or video information from a DVD and generate a baseband signal based thereon.

The modulation circuit 104 may be operative to receive the baseband signal 107 and generate a modulated signal 109 based thereon. The modulated signal 109 is of a type that is compatible with the output device 106, such as an analog TV or TV receiver. For example, if the output device 106 is capable of receiving a frequency modulated (FM) signal, the modulation circuit 104 may receive the baseband signal 107 and generate an FM modulated signal. The modulation circuit 104 may include a direct digital synthesis circuit 108. The direct digital synthesis circuit 108 may be operative to suppress harmonics of subcarriers that include audio and/or video information, which are typically included in the modulated signal 109. Suppressing harmonics in subcarriers may effectively reduce inference with adjacent frequency bands or channels.

The output device 106 may be operative to receive the modulated signal 109 and generate an audio and/or video output based thereon. The output device 106 may be any suitable device capable of generating an audio and/or video output. Exemplary output devices 106 include, but are not limited to, a television, a radio, or any other suitable device.

Figure 4:
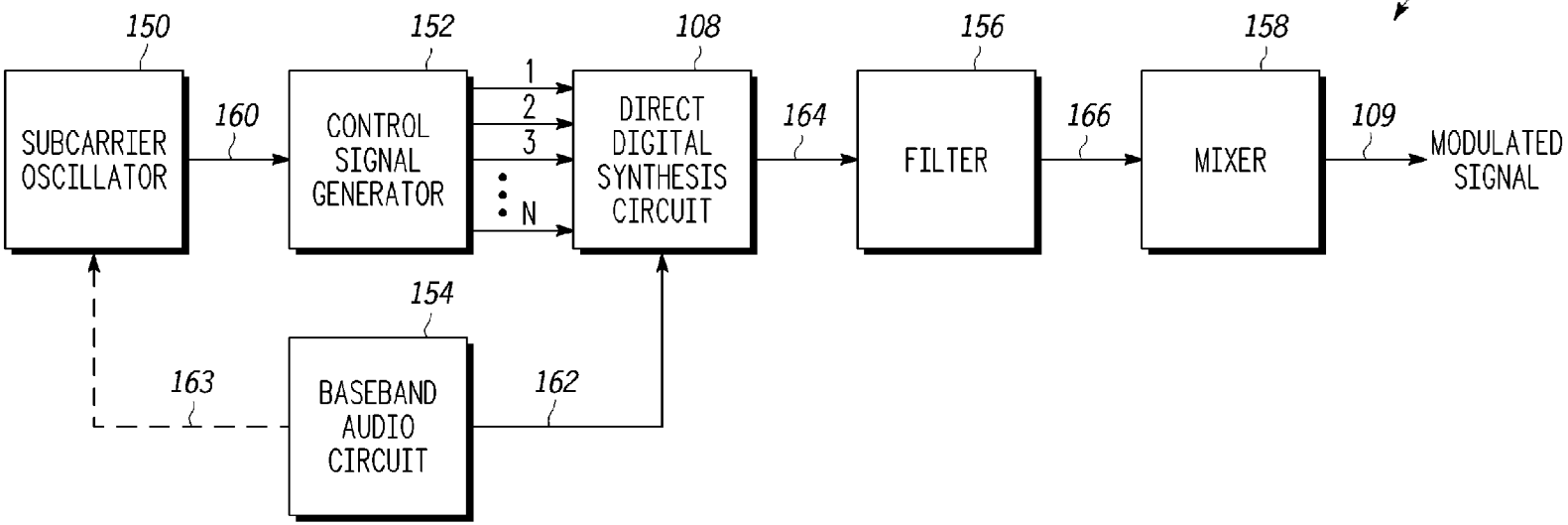
FIG. 4 is an exemplary functional block diagram of the modulation circuit.

Referring now to FIG. 4, the modulation circuit 104 may include a subcarrier oscillator 150, a control signal generator circuit (e.g., divider circuit) 152, the direct digital synthesis circuit 108, a baseband audio circuit 154, a filter 156, and a mixer 158. The subcarrier oscillator 150 may be operative to provide a subcarrier frequency 160. The control signal generator 152 may be operative to receive the subcarrier frequency 160 from the subcarrier oscillator 150 and generate a plurality of control signals 1, 2, . . . , N based thereon. The baseband audio circuit 154 is operative to provide an amplitude modulating signal 162 or a frequency modulating signal 163. The direct digital synthesis circuit 108 is operative to receive the control signals 1, 2, . . . , N and generate an amplitude modulated synthesized waveform 164 with suppressed harmonics based on the modulating signal 162 and the control signals 1, 2, . . . , n. In some embodiments, where the modulating signal 162 is for amplitude modulation (AM), the direct digital synthesis circuit 108 may be operative to receive the modulating signal 162 from the baseband audio circuit 154. In other embodiments, where the modulating signal 163 is for frequency modulation (FM), the subcarrier oscillator 150 may be operative to receive the modulating signal 163.

The filter 156 may be operative to receive the synthesized waveform 164 and provide a filtered synthesized waveform 166 with additional harmonics suppressed. For example, if the first nine harmonics are suppressed in the synthesized waveform 164, the filter 156 may be operative to filter additional harmonics greater than the first nine harmonics. The mixer 158 may be operative to receive the filtered synthesized waveform 166 and generate the modulated signal 109 based thereon. Although, in this example, the mixer 158 generates the modulated signal 109 based the filtered synthesized waveform 166, skilled artisans will appreciate that the mixer 158 may generate the modulated signal 109 based on the synthesized waveform 164.

Figure 5:
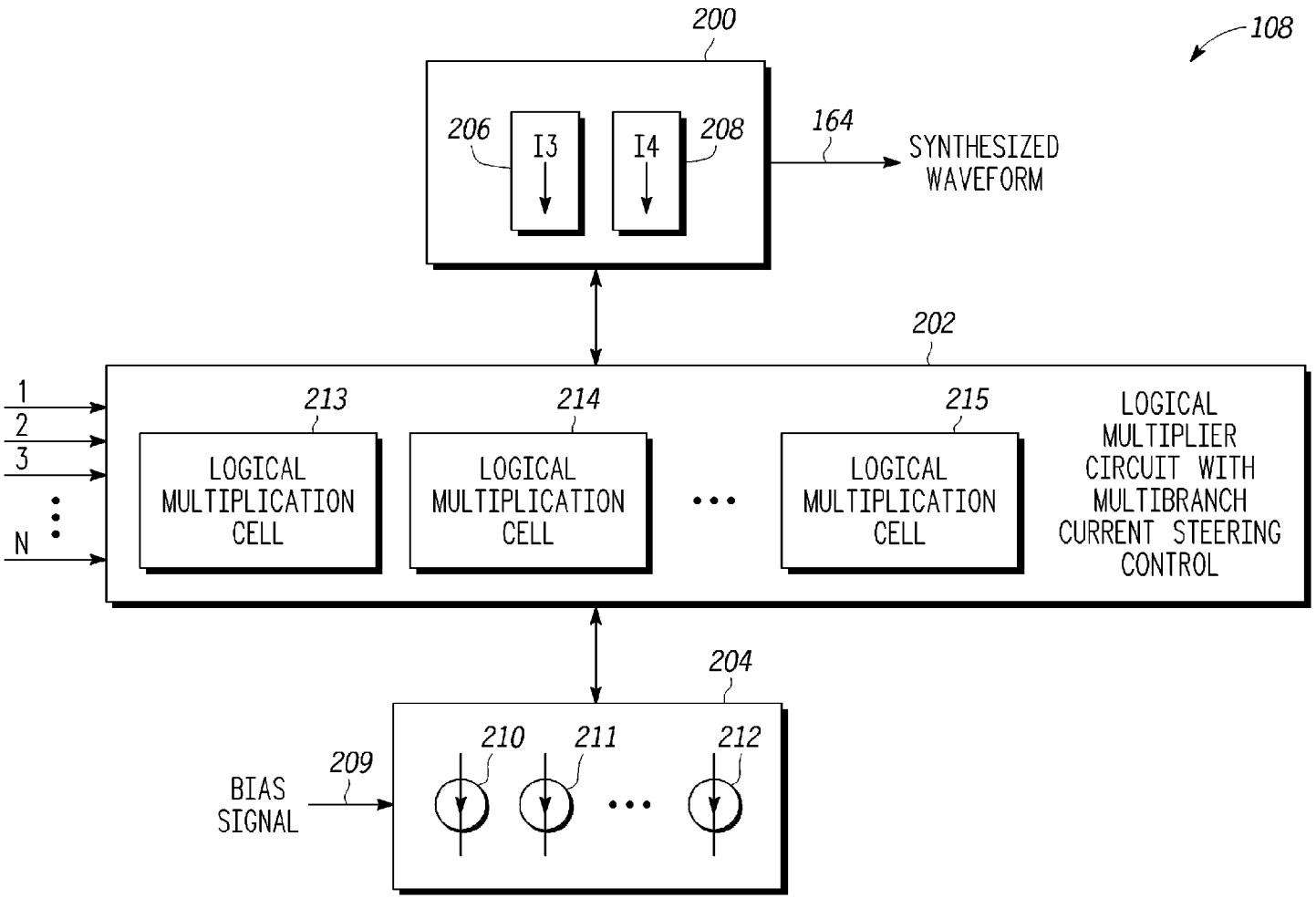
FIG. 5 is an exemplary functional block diagram of the direct digital synthesis circuit.

Referring now to FIG. 5, the direct digital synthesis circuit 108 may include an output circuit 200, a logical multiplier circuit 202, and a current source circuit 204. The output circuit 200 may be operatively coupled to the logical multiplier circuit 202, which may be operatively coupled to the current source circuit 204.

The output circuit 200 is operative to provide an output for the synthesized waveform 164. The output circuit 200 may include a first and second branch 206, 208. The first and second branches 206, 208 are operative to work in conjunction in order to provide the synthesized waveform 164. More specifically, the first and second branches 206, 208 are operative to provide a first and second current I3, I4 based on control signals 1, 2, . . . n. When the first current I3 is increased by a determined magnitude, the second current I4 is decreased by the same determined magnitude and vice versa.

The current source circuit 204 may be operative to receive a bias signal 209. The determined magnitude may be based on the bias signal 209 received by the current source circuit 204. In some embodiments, the bias signal 209 may be the amplitude modulating signal 162. In other embodiments, where the modulating signal is the frequency modulating signal 163, the bias signal 209 may be a constant value. The current source circuit 204 may include a plurality of current sources 210, 211, . . . , 212 operative to provide current. The logical multiplier circuit 202 may be operative to receive the control signals 1, 2 . . . , N and selectively steer current through the first and second branches 206, 208. More specifically, the logical multiplier circuit 202 may include a plurality logical multiplication cells 213, 214, . . . , 215. Logical multiplier cell 213 may be referred to as an initial cell whereas logical multiplier cells 214, . . . , 215 may be referred to as next cells. The logical multiplication cells 213, 214, . . . , 215 are operative to multiply current provided by the current source circuit 204 by a 1 or 0 based on signals 1, 2, . . . , n. In this manner, each logical multiplication cell 213, 214, . . . , 215 acts as a plurality of switches and the logical multiplication cells 213, 214, . . . , 215 act collectively to steer the current provided by the current source circuit 204 between the first and second branch 206, 208. For example, the first current I3 may be steered through the first branch 206 and the second current I4 may be steered through the second branch 208. When the logical multiplication cells 213, 214, . . . , 215 collectively act to increase (or decrease) the first current I3 by the determined magnitude, the second current I4 is decreased (or increased) by the same determined magnitude. The synthesized waveform 164 may be based on a combination or summation of the first and second currents I3, I4.

The harmonics suppressed in the synthesized waveform 164 may be based on the number of logical multiplication cells 213, 214, . . . , 215. For example, each of the logical multiplication cells 213, 214, . . . , 215 may be operative to include a unique weighted current flow, which may be determined from a system of linear Fourier transform equations. A summation of the weighted currents from N logical multiplication cells 213, 214, . . . , 215 may provide suppression of up to the 4N-2 harmonic in the synthesized waveform 164. Thus, if it is desirable to suppress the sixth harmonic from the synthesized waveform 164, the logical multiplication circuit 202 would require two logical multiplication cells.

If it is desired to suppress more harmonics, the logic multiplication cells 213, 214, . . . , 215, current sources 210, 211, . . . , 212, and control signals 1, 2, . . . , N can be expanded accordingly. For example, for every next logical multiplication cell 214, . . . , 215 added, an additional two current sources may be added along with two additional control signals. It will be recognized that adding the additional control signals would require a reconfiguration of the control signals 1, 2, . . . , N and the current supplied by the current sources 210, 211, . . . , 212. The equations, listed below, can be used to determine the value of the current supplied by the current sources 210, 211, . . . , 212 and the shape of the control signals 1, 2, . . . , n.

The control signals for the initial logical multiplier cell 213 may be represented with the following equations:

$$c_0(t) = \frac{1}{2} + \frac{2}{\pi}\sum_{n=1}^{\infty}\left(\frac{4}{n\pi}\right)\mathrm{Sin}\left(2\pi n\frac{t}{T}\right)$$

$$c_0'(t) = |1 - c_o(t)|$$

where $c_0$ (t) is the first control signal for the initial logical multiplier cell 213, $c'_0$ (t) is the second control signal for the initial logical multiplier cell 213, and T is the period of the subcarrier frequency.

The control signals $c_0(t)$ and $c_1(t)$ may control the initial logical multiplier cell 213 to generate an initial waveform represented by the following equation:

$$f_0(t) = A_0\sum_{n=1}^{\infty}\left(\frac{4}{n\pi}\right)\mathrm{Sin}\left(2\pi n\frac{t}{T}\right)$$

for odd values of n where $f_o(t)$ is the initial waveform, $A_o$ is the amplitude of the initial waveform, and T is the period of the subcarrier frequency.

The control signals for each next logical multiplier cell 214, . . . , 215 may be represented with the following equation:

$$c_i(t) = \frac{2w_i}{T} + \frac{2}{\pi}\sum_{n=1}^{\infty}\left(\frac{(-1)^n}{n}\right)\mathrm{Sin}\left(2\pi n\frac{w_i}{T}\right)\mathrm{Cos}\left(4\pi n\frac{t}{T}\right) \quad i = 1, 2, 3, \ldots, N-1$$

$$c_i'(t) = |1 - c_i(t)|$$

where $c_i(t)$ and $c'_i(t)$ represents the control signals for the next logical multiplication cells 214, . . . , 215, T is the period of the subcarrier frequency, and $w_i$ is the width of the rectangular wave pulses.

The control signals $c_i(t)$ and $c'_i(t)$ may control each next logical multiplier cell 214, . . . , 215 to generate next waveforms represented by the following equation:

$$f_i(t) = A_i\sum_{n=1}^{\infty}\mathrm{Sin}\left(\frac{n\pi}{2}\right)\left(\frac{\mathrm{Sin}\left(\frac{n\pi w_i}{T}\right)}{\left(\frac{n\pi w_i}{T}\right)}\right)\mathrm{Sin}\left(2\pi n\frac{t}{T}\right) \quad i = 1, 2, 3, \ldots, N-1$$

where $f_i(t)=0$ for all even n and $f_i(t)$ represents each next waveform, $A_i$ is the amplitude if each next waveform, T is the period of the subcarrier frequency, and $w_i$ is the width of each next waveform.

If there are N-1 widths, $w_i$, for each next multiplier cell 214, . . . , 215, the widths may be represented with the following equation:

$$w_i = \frac{i}{2N}T \quad \text{for } i = 1, 2, \ldots, N-1$$

where N is the total number of logical multiplication cells 213, 214, . . . , 215 and T is the period of the subcarrier frequency.

The initial $f_o(t)$ and next $f_i(t)$ may be combined to form the synthesized waveform 164, which may be represented by the following equation:

$$f(t) = \sum_{n=1}^{\infty}\mathrm{Sin}\left(2\pi n\frac{t}{T}\right)\left(A_0\left(\frac{4}{n\pi}\right) + \sum_{i=1}^{N-1}A_i\mathrm{Sin}\left(\frac{n\pi}{2}\right)\frac{\mathrm{Sin}\left(\frac{n\pi i}{2N}\right)}{\left(\frac{n\pi i}{2N}\right)}\right)$$

for n odd where f(t) is the synthesized waveform 164, $A_o$ is the amplitude of the initial waveform, $A_i$ is the amplitude if each next waveform, and T is the period of the subcarrier frequency.

Since only odd harmonics occur in the synthesized waveform 164, the amplitude for each odd harmonic may be represented with the following equation:

$$A(n) = \left( A_0\left(\frac{4}{n\pi}\right) + \sum_{i=1}^{N-1} A_i \mathrm{Sin}\left(\frac{n\pi}{2}\right) \frac{\mathrm{Sin}\left(\frac{n\pi i}{2N}\right)}{\left(\frac{n\pi i}{2N}\right)} \right)$$

where A(n) is the amplitude of each odd harmonic, $A_o$ is the amplitude of the initial waveform, $A_i$ is the amplitude of each next waveform, and N is the total number of logical multiplication cells 213, 214, . . . , 215.

The relative amplitudes of the current sources 210, 211, . . . , 212 may be determined by setting the amplitudes of the harmonics, A(n), to a desired value and solving for $A_0$ through $A_{N-1}$ from the following linear system:

$$\begin{bmatrix} A(1) \\ A(3) \\ \dots \\ A(2N-1) \end{bmatrix} = \begin{bmatrix} A_0 \\ A_1 \\ \dots \\ A_{N-1} \end{bmatrix} \times \begin{bmatrix} g_0(1) & g_1(1) & \dots & g_{N-1}(1) \\ g_0(3) & g_1(3) & \dots & g_{N-1}(3) \\ \dots & \dots & \dots & \dots \\ g_0(2N-1) & g_1(2N-1) & \dots & g_{N-1}(2N-1) \end{bmatrix}$$

where A(n) is the amplitude for each harmonic, $A_0$ is the amplitude for the initial waveform, $A_{N-1}$ is the amplitude for each next waveform, and the $g_i(n)$ are scaling factors for the relative contribution to the nth harmonic amplitude from the ith logical multiplication cell.

For example, if suppression of harmonics above the first harmonic is desired, A(1) may be set to 1 and A(3) to A(2N-1) may be set to 0. While the above linear system only specifies harmonic amplitudes to the A(2N-1) harmonic, skilled artisans will appreciate that all harmonic amplitudes through A(4N-2) may be suppressed. It will also be recognized that some higher harmonics may also be suppressed.

The scaling factors for the relative contribution to the nth harmonic amplitude from the ith logical multiplication cell may be represented with the following equations:

$$g_0(n) = \left(\frac{4}{n\pi}\right)$$

$$g_i(n) = \mathrm{Sin}\left(\frac{n\pi}{2}\right)\left(\frac{\mathrm{Sin}\left(\frac{n\pi i}{2N}\right)}{\left(\frac{n\pi i}{2N}\right)}\right) \qquad i = 1, 2, \dots, N-1$$

where $g_0(n)$ is the scaling factor for the first logical multiplication cell, and the $g_i(n)$ are the scaling factors for the next logical multiplication cells.

The current source values may be determined based on the amplitudes of the waveforms $A_o$, the amplitude of the initial waveform, and $A_i$, the amplitudes of each next waveform. For example, if there are three current sources, a first current source may provide current I1 and other current sources may provide current I2. The values of currents I1 and I2 may be determined with the following equations:

$$\frac{2I_2}{I_1 - I_2} = \frac{A_0}{A_1} = \sqrt{2}$$

$$\frac{I_1}{I_2} = 1 + \sqrt{2}$$

Figure 6:
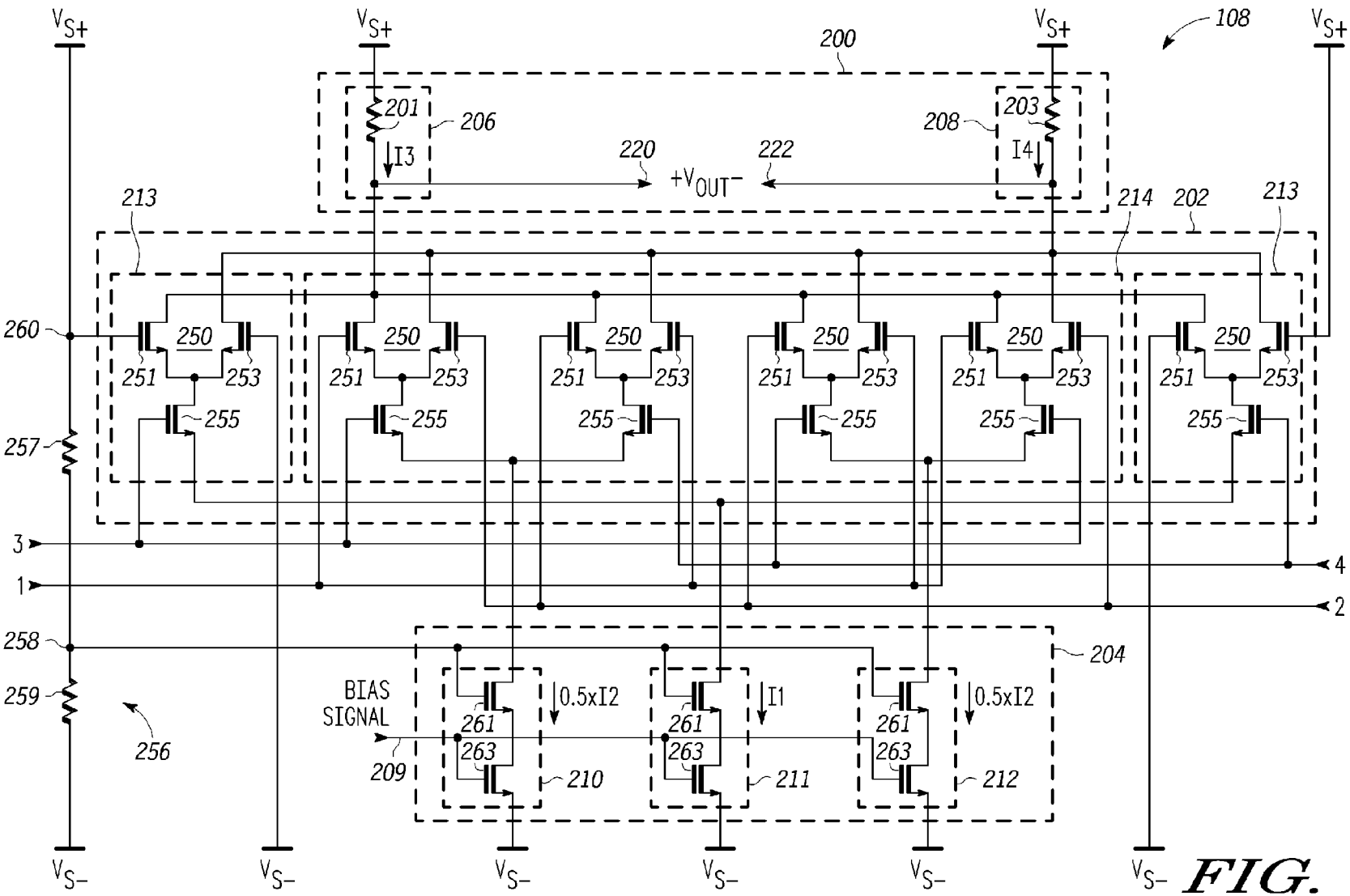
FIG. 6 is an exemplary circuit diagram of the direct digital synthesis circuit.

Referring now to FIG. 6, an exemplary circuit diagram of the direct digital synthesis circuit 108 is depicted. The output circuit 200 may include resistive elements 201 and 203, such as a resistor or other element(s) that provides a suitable resistance. The first branch 206 of the output circuit 200 may be implemented with resistive element 201 and the second branch 208 may be implemented with resistive element 203. Resistive element 201 may be operatively coupled between Vs+ and the logical multiplication circuit 202. Although depicted as a positive voltage, skilled artisans will appreciate that Vs+ may be any voltage that is greater than Vs− including ground. Resistive element 203 may be operatively coupled between Vs+ and logical multiplication circuit 202.

Resistance values for resistive elements 201 and 203 should be approximately equivalent. In some embodiments, the resistance values of resistive elements 201 and 203 are approximately 750 Ohms when Vs+ and Vs− are set to 1.8 Volts and 0 Volts, respectively. As previously discussed, during operation the first and second branches 206, 208 are operative to provide the first and second currents I3, I4 based on control signals 1, 2, 3, 4. The first and second currents I3, I4 act to generate a voltage output, Vout, at output terminals 220 and 222, which is a voltage representation of the synthesized waveform 164.

In this example, the logical multiplication circuit 202 is implemented with initial logical multiplication cell 213 and next logical multiplication cell 214. Although only one next logical multiplication cell 214 is used in this example, skilled artisans will appreciate that more or less next logical multiplication cells 214, . . . , 215 may be used depending on the number of harmonics to be suppressed from the synthesized waveform 164. Logical multiplier cells 213, 214 may include multiple logical multiplication stages 250. In some embodiments, initial logical multiplication cell 213 may include two logical multiplication stages 250 and each next logical multiplication cell 214 may include four logical multiplication stages 250.

Each logical multiplication stage 250 may comprise three transistors 251, 253, 255. In some embodiments, transistors 251, 253, 255 may comprise metal oxide semiconductor transistors (MOSFETs). Although depicted as n-channel MOSFETs in this particular example, skilled artisans will appreciate that the logical multiplication stages 213, 214 may be implemented with p-channel MOSFETs or a combination of n-channel and p-channel MOSFETs (i.e., CMOS).

A drain terminal of transistors 251 and 253 may be operatively coupled to the output circuit 200. A source terminal of transistor 255 may be operatively coupled to the current source circuit 204. A drain terminal of transistor 255 may be operatively coupled to a source terminal of transistors 251 and 253. In addition, at least one logical multiplication stage 250 may be operatively coupled to Vs+.

A voltage divider circuit 256 is operative to provide a reference for the current source circuit 204. The voltage divider circuit 256 may comprise resistive elements 257 and 259 such as a resistor or other element(s) that provides a suitable resistance. Resistive elements 257 and 259 may be operatively coupled in series between Vs+ and Vs−. Although depicted as a negative voltage, skilled artisans will appreciate that Vs− may be any voltage that is less than Vs+ including ground. The voltage divider circuit 256 may be operatively coupled to the current source circuit 204 at node 258. The voltage divider circuit 256 may also be operatively coupled to a gate terminal of at least one transistor 251. The values of resistive elements 257 and 259 should be chosen such that the voltage at 258 provides a voltage reference for the current source circuit 204. For example, resistive elements 257 and 259 may be 6,000 Ohms and 12,000 Ohms, respectively, and Vs+ and Vs− may be 1.8 Volts and 0 Volts, respectively. However any suitable values and voltages may be used.

The current source circuit 204 may be implemented with three current sources 210, 211, 212. Although three current sources 210, 211, 212 are depicted in this example, skilled artisans will appreciate that more or less current sources may be used. Each current source 210, 211, 212 may be implemented in any suitable manner and in this particular example are configured with two transistors 261 and 263 operatively coupled in a cascode arrangement, however any suitable structure may be used. A gate terminal of transistor 263 may be operative to receive the bias signal 209. In this example, current source 211 provides current I1 and current sources 210 and 212 each provide half of current I2. In this manner, the logical multiplication circuit 202 may steer three source current magnitudes through the first and second branches 206, 208 in order to generate the synthesized waveform 164.

Figure 7:
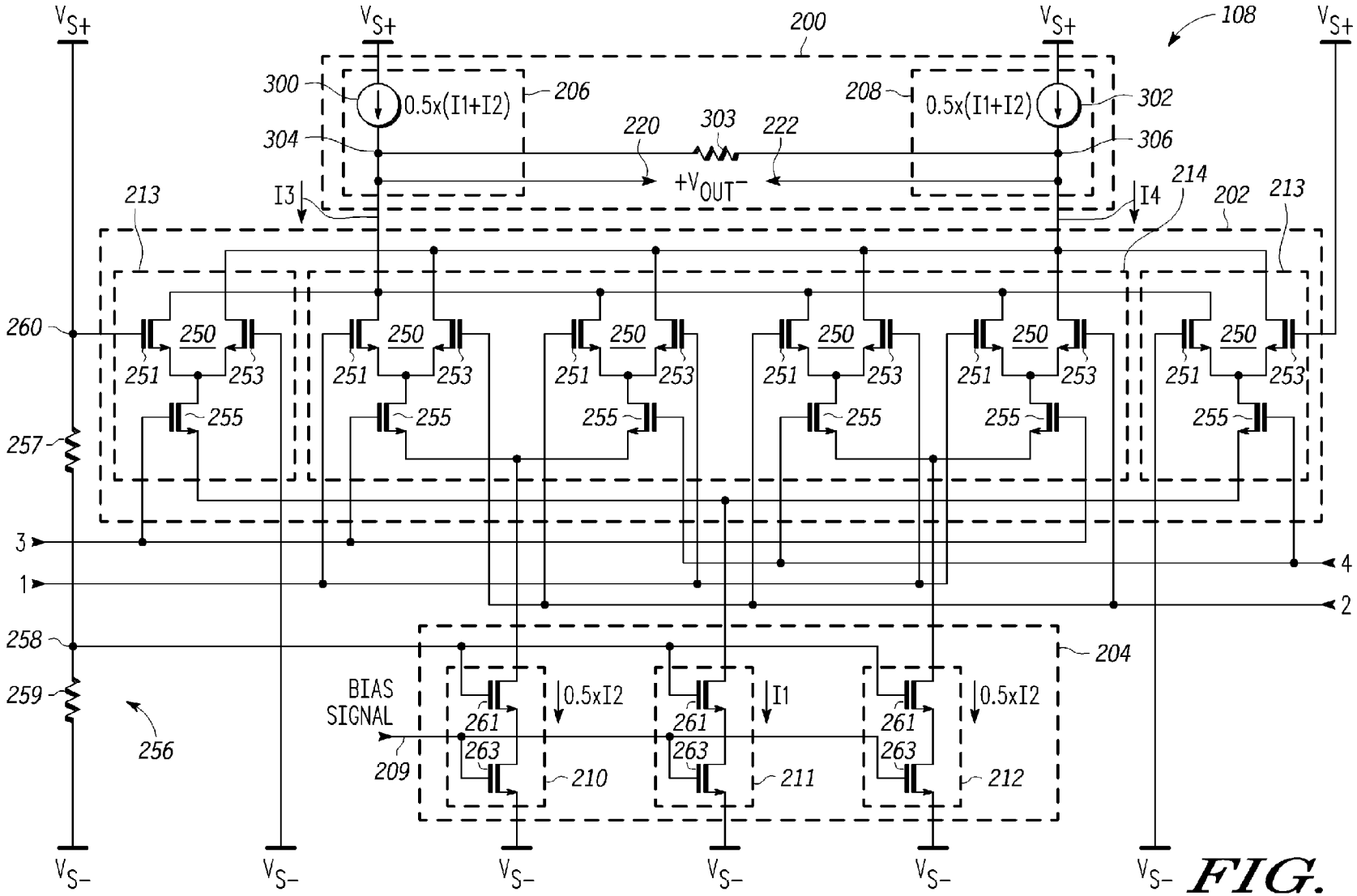
FIG. 7 is an alternative exemplary circuit diagram of the direct digital synthesis circuit.

Referring now to FIG. 7, a second exemplary implementation of the direct digital synthesis circuit 108 is depicted. The logical multiplication and current source circuits 202, 204 are identical to the embodiment depicted in FIG. 6. However, the output circuit 200 comprises current sources 300 and 302 and a resistive element 303, such as a resistor or other element(s) that provides a suitable resistance. The first branch 206 of the output circuit 200 may be implemented with current source 300 and the second branch 208 may be implemented with current source 302. Current source 300 may be operatively coupled between Vs+ and resistive element 303 at node 304. Current source 302 may be operatively coupled between Vs+ and resistive element 303 at node 306. Current sources 300 and 302 should each provide a current that is approximately half of the current provided by the current source circuit. Resistive element 303 should have a resistance value that is equal to a sum of resistive elements 201 and 203 of FIG. 6. In some embodiments, resistive element 303 may be 1500 Ohms, Vs+ may be 1.8 Volts, Vs−may be 0 Volts, I2 may be 41.42135 uA, and I1 may be I2 $(1+\sqrt{2})$, or 200 uA.

As with the embodiment disclosed in FIG. 6, during operation the first and second branches 206, 208 are operative to provide the first and second currents I3, I4 based on control signals 1, 2, 3, 4. The first and second currents I3, I4 act to generate Vout across resistive element 303, which is a voltage representation of the synthesized waveform 164.

Figure 8:
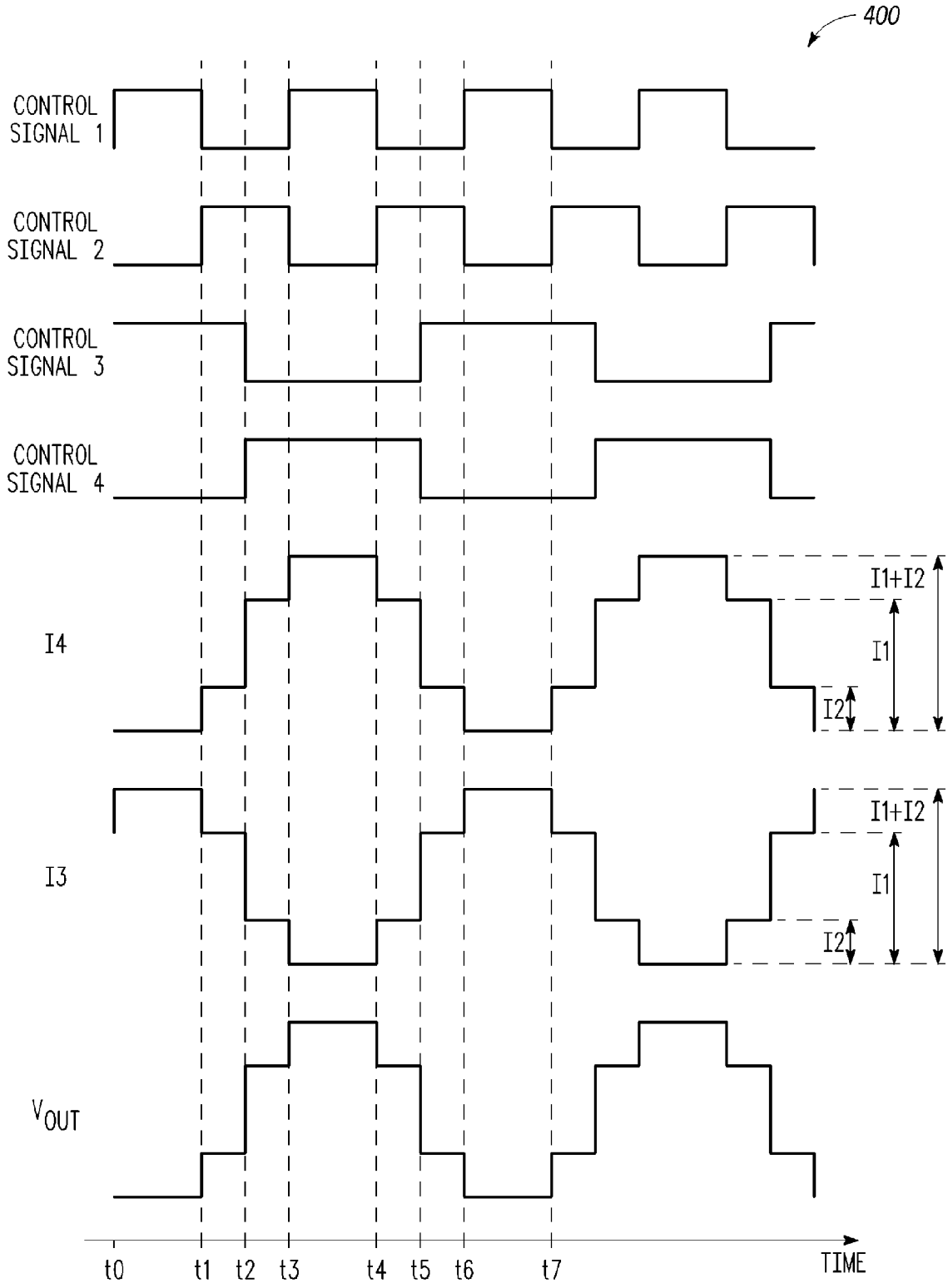
FIG. 8 is an exemplary timing diagram illustrating operation of the direct digital synthesis circuit.

Referring now to FIG. 8, an exemplary timing diagram is generally depicted at 400. As shown, at time t0 control signal 3 is high and control signal 4 is low and control signal 2 transitions low and control signal 1 transitions high, which causes I4 to decrease by I2 and I3 to increase by I2. The combination of I3 and I4 at time t0 cause Vout, which is a voltage representation of the synthesized waveform 164, to decrease by a multiple of I2. At time t1, control signal 1 transitions low and control signal 2 transitions high causing I4 to increase by I2 and I3 to decrease by I2. The combination of I3 and I4 at time t1 cause Vout to increase by a multiple of I2. At time t2, control signal 3 transitions low and control signal 4 transitions high causing 14 to increase by I1 and I3 to decrease by I1. The combination of I3 and I4 at time t2 cause Vout to increase by a multiple of I1. At time t3, control signal 1 transitions high and control signal 2 transitions low causing I4 to increase by I2 and I3 to decrease by I2. The combination of I3 and I4 at time t3 cause Vout to increase by a multiple of I2. At time t4, control signal 1 transitions low and control signal 2 transitions high causing I4 to decrease by I2 and I3 to increase by I2. The combination of I3 and I4 at time t4 cause Vout to decrease by a multiple of I2. At time t5, control signal 3 transitions high and control signal 4 transitions low causing I4 to decrease by I1 and I3 to increase by I1. The combination of I3 and I4 at time t5 cause Vout to decrease by a multiple of I1. At time t6, control signal 1 transitions high and control signal 2 transitions low causing I4 to decrease by I2 and I3 to increase by I2. The combination of I3 and I4 at time t6 cause Vout to decrease by a multiple of I2. At time t7, control signal 1 transitions low and control signal 2 transitions high causing 14 to increase by I2 and I3 to decrease by I2. The combination of I3 and I4 at time t7 cause Vout to increase by a multiple of I2. As shown, when 13 increases by a determined amount, I4 decreases by the same determined amount and vice versa.

The direct digital synthesis circuit 108 may be incorporated with any suitable apparatus as desired such as, but not limited to, a multimedia apparatus such as a DVD player, or other suitable device that may employ a DDS.

As noted above, the direct digital synthesis circuit, among other advantages, generates a synthesized waveform that suppresses subcarrier harmonics. The direct digital synthesis circuit may also exhibit improved common mode rejection over prior art circuits. In addition, the directed digital synthesis circuit may be implemented in a single integrated circuit or included in an integrated circuit with additional modulation components. Implementing the direct digital synthesis circuit in a single integrated circuit minimizes size and hence costs. Furthermore, the use of MOSFETs may allow for the direct digital synthesis circuit to operate with a reduced supply voltage, which reduces power consumption. Other advantages will be recognized by those of ordinary skill in the art.

While this disclosure includes particular examples, it is to be understood that the disclosure is not so limited. Numerous modifications, changes, variations, substitutions and equivalents will occur to those skilled in the art without departing from the spirit and scope of the present disclosure upon a study of the drawings, the specification and the following claims.

What is claimed is:

1. A direct digital synthesis circuit comprising:

a plurality of current sources;

an output circuit, comprising a first and second branch, that provides a synthesized waveform output; and a logical multiplier circuit, operatively coupled to the plurality of current sources and to the output circuit, that is operative to receive a plurality of signals and selectively increase a first current flow through the first branch by a determined magnitude and decrease a second current flow through the second branch by the determined magnitude based on the plurality of signals, wherein the synthesized waveform is based on the first and second currents.

2. The direct digital synthesis circuit of claim 1 wherein the first branch comprises a first resistive element operatively coupled to the logical multiplier circuit and the second branch comprises a second resistive element operatively coupled to the logical multiplier circuit.

3. The direct digital synthesis circuit of claim 1 wherein the output circuit further comprises a resistive element operatively coupled between the first and second branches and wherein the first branch comprises a first current source operatively coupled to the logical multiplier circuit and to the resistive element and the second branch comprises a second current source operatively coupled to the logical multiplier circuit and to the resistive element.

4. The direct digital synthesis circuit of claim 1 wherein the plurality of current sources are operative to receive a modulating signal and wherein the determined magnitude of current flow is based on the modulating signal.

5. The direct digital synthesis circuit of claim 1 wherein the logical multiplier circuit comprises N logical multiplication cells that each comprise a plurality of metal oxide semiconductor field effect transistor (MOSFET) logical multiplication stages, wherein N is greater than 1, and wherein the N logical multiplication cells provide suppression of up to a 4N-2 harmonic in the synthesized waveform output.

6. The direct digital synthesis circuit of claim 5 wherein each of the plurality of MOSFET logical multiplication stages comprise a first, second, and third MOSFET, wherein the first MOSFET includes a first terminal operatively coupled to the output circuit, the second MOSFET includes a second terminal operatively coupled to the output circuit, and the third MOSFET includes a third terminal operatively coupled to at least one of the plurality of current sources and a fourth terminal operatively coupled to a fifth terminal of the first MOSFET and to a sixth terminal of the second MOSFET.

7. An integrated circuit comprising:

a subcarrier oscillator circuit that is operative to generate a subcarrier frequency;

a control signal generator that is operative to receive the subcarrier frequency and generate a plurality of signals based thereon; and a direct digital synthesis circuit that comprises:

a plurality of current sources, an output circuit, comprising a first and second branch, that provides a synthesized waveform output, and a logical multiplier circuit, operatively coupled to the plurality of current sources and to the output circuit, that is operative to receive the plurality of signals and selectively increase a first current flow through the first branch by a determined magnitude and decrease a second current flow through the second branch by the determined magnitude based on the plurality of signals, wherein the synthesized waveform is based on the first and second currents.

8. The integrated circuit of claim 7 wherein the first branch comprises a first resistive element operatively coupled to the logical multiplier circuit and the second branch comprises a second resistive element operatively coupled to the logical multiplier circuit.

9. The integrated circuit of claim 7 wherein the output circuit further comprises a resistive element operatively coupled between the first and second branches and wherein the first branch comprises a first current source operatively coupled to the logical multiplier circuit and to the resistive element and the second branch comprises a second current source operatively coupled to the logical multiplier circuit and to the resistive element.

10. The integrated circuit of claim 7 wherein the plurality of current sources are operative to receive an amplitude modulating signal and wherein the determined magnitude of current flow is based on the amplitude modulating signal.

11. The integrated circuit of claim 7 wherein the logical multiplier circuit comprises N logical multiplication cells that each comprise a plurality of metal oxide semiconductor field effect transistor (MOSFET) logical multiplication stages, wherein N is greater than 1, and wherein the N logical multiplication cells provide suppression of up to a 4N-2 harmonic in the synthesized waveform output.

12. The integrated circuit of claim 11 wherein each of the plurality of MOSFET logical multiplication stages comprise a first, second, and third MOSFET, wherein the first MOSFET includes a first terminal operatively coupled to the output circuit, the second MOSFET includes a second terminal operatively coupled to the output circuit, and the third MOSFET includes a third terminal operatively coupled to at least one of the plurality of current sources and a fourth terminal operatively coupled to a fifth terminal of the first MOSFET and to a sixth terminal of the second MOSFET.

13. The integrated circuit of claim 7 further comprising a radio frequency mixer operative to generate a radio frequency signal based on the synthesized waveform.

14. The integrated circuit of claim 7 wherein the subcarrier oscillator is operative to receive a frequency modulating signal and generate the subcarrier frequency based thereon.

15. An apparatus comprising:

an input circuit operative to generate a baseband signal; and a modulation circuit that comprises:

a baseband circuit operative to receive the baseband signal and generate a modulating signal based thereon, a subcarrier oscillator circuit that is operative to generate a subcarrier frequency, and a control signal generator that is operative to receive the subcarrier frequency and generate a plurality of signals based thereon, and a direct digital synthesis circuit that comprises:

a plurality of current sources, an output circuit, comprising a first and second branch, that provides a synthesized waveform output, and a logical multiplier circuit, operatively coupled to the plurality of current sources and to the output circuit, that is operative to receive the plurality of signals and selectively increase a first current flow through the first branch by a determined magnitude and decrease a second current flow through the second branch by the determined magnitude based on the plurality of signals, wherein the determined magnitude is based on the modulating signal and the synthesized waveform is based on the first and second currents.

16. The apparatus of claim 15 wherein the first branch comprises a first resistive element operatively coupled to the logical multiplier circuit and the second branch comprises a second resistive element operatively coupled to the logical multiplier circuit.

17. The apparatus of claim 15 wherein the output circuit further comprises a resistive element operatively coupled between the first and second branches and wherein the first branch comprises a first current source operatively coupled to the logical multiplier circuit and to the resistive element and the second branch comprises a second current source operatively coupled to the logical multiplier circuit and to the resistive element.

18. The apparatus of claim 15 wherein the logical multiplier circuit comprises a plurality of logical multiplication cells that each comprise a plurality of metal oxide semiconductor field effect transistor (MOSFET) logical multiplication stages.

19. The apparatus of claim 18 wherein each of the plurality of MOSFET logical multiplication stages comprise a first, second, and third MOSFET, wherein the first MOSFET includes a first terminal operatively coupled to the output circuit, the second MOSFET includes a second terminal operatively coupled to the output circuit, and the third MOSFET includes a third terminal operatively coupled to at least one of the plurality of current sources and a fourth terminal operatively coupled to a fifth terminal of the first MOSFET and to a sixth terminal of the second MOSFET.

20. The apparatus of claim 15 comprising a mixer operatively coupled to the direct digital synthesis circuit and operative to produce a modulated signal based on the synthesized waveform output.

* * * * *

UNITED STATES PATENT AND TRADEMARK OFFICE

CERTIFICATE OF CORRECTION

PATENT NO. : 7,653,678 B2
APPLICATION NO. : 11/457380
DATED : January 26, 2010
INVENTOR(S) : Bushman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 866 days.

Signed and Sealed this

Eighteenth Day of January, 2011

David J. Kappos

David J. Kappos
*Director of the United States Patent and Trademark Office*